United States Patent [19]

Eriksson et al.

[11] 4,032,361

[45] June 28, 1977

[54] METHOD AND APPARATUS FOR CONTROLLED SEPARATION OF SUBSTANCES BY HEATING

[75] Inventors: Hans Georg Eriksson; Karl Gösta Sjöberg, both of Finspang; Karl Börje Löfgren, Vasteras, all of Sweden

[73] Assignee: Granges Essem Aktiebolag Fack, Vasteras, Sweden

[22] Filed: Mar. 24, 1976

[21] Appl. No.: 670,171

[30] Foreign Application Priority Data

Mar. 25, 1975 Sweden ..... 7503476

[52] U.S. Cl. ..... 134/19; 110/8 A; 134/38

[51] Int. Cl.[2] ..... B08B 5/00

[58] Field of Search ..... 134/19, 38; 34/32, 35; 110/8 A; 201/27, 37

[56] References Cited

UNITED STATES PATENTS

| | | | |
|---|---|---|---|
| 3,250,643 | 5/1966 | Sergent | 134/38 X |
| 3,627,289 | 12/1971 | Erman | 134/19 |
| 3,705,711 | 12/1972 | Seelandt et al. | 134/19 X |
| 3,716,001 | 2/1973 | Potasek et al. | 110/8 A |
| 3,806,322 | 4/1974 | Tabak | 110/8 A X |

*Primary Examiner*—S. Leon Bashore
*Assistant Examiner*—Marc L. Caroff
*Attorney, Agent, or Firm*—Browdy and Neimark

[57] ABSTRACT

A method for controlled separation of substances by heating, e.g. for removing paint or other coatings on scrap metal, includes heating in an oven chamber the material from which one or more substances are to be separated to a temperature sufficiently high to provide evaporation of the substances to be separated, by means of a circulating gas. The gas is circulated from the oven chamber to a combustion chamber, where it is burned, and then to a large extent recirculated back to the oven chamber. The burning in the combustion chamber is intended to facilitate the destruction or collection of harmful substances emitted in the oven chamber and generates the heat necessary for providing and sustaining the desired temperature in the oven chamber. Controlling the recirculating gas stream will provide close control of the separation process in the oven chamber and, thus, facilitate the cleaning of the gas quantity diverted from the combustion chamber to the atmosphere. An oven for carrying out this method is also disclosed.

14 Claims, 4 Drawing Figures

METHOD AND APPARATUS FOR CONTROLLED SEPARATION OF SUBSTANCES BY HEATING

The present invention relates to a method for controlled separation of substances by heating, including the steps of introducing the material from which one or more substances are to be separated into a closed oven chamber and heating the material. The method is particularly, but not exclusively, intended for destruction of paint and varnish layers on metal sheets, particularly aluminum plates. The invention also relates to a separation oven for carrying out the method.

In connection with all handling of waste and refuse it is a condition that the destruction of the waste or refuse can take place without dispersal of poisonous or polluting substances in the environment around the place where the destruction process takes place. Destruction processes related to waste or refuse disposal include normally heating or burning of the waste or the refuse. In connection therewith large gas quantities are formed and released, and these quantities have to be cleaned to a high degree for fulfilling the above mentioned condition. Furthermore, it is frequently desirable to recover from the formed gases the substances which are valuable or which must not be spread out for environmental reasons. In order to obtain an effective and economical cleaning and recovery it is highly desirable that the destruction processes be closely controlled and supervised.

Waste or refuse destruction has previously been provided by burning the waste or refuse in special incinerators. The U.S. Pat. No. 3,716,001 discloses an incinerator including a primary incinerator chamber for the burning of the refuse and a secondary combustion chamber in which the gases formed and released in the incinerator chamber are burned to a great extent. The incinerator chamber is connected to the front end of the combustion chamber by a first conduit through which the released gases can flow into the combustion chamber. The rear end of the combustion chamber is connected to the incinerator chamber through a second conduit through which oxygen from the combustion chamber is supplied to the incinerator chamber for controlling the burning process. Through the second conduit between the combustion chamber and the incinerator chamber also heat is obtained from the combustion chamber for setting fire to the refuse and for sustaining the burning. Furthermore, the combustion chamber is connected to a stack or similar device for exhausting the gases from the combustion chamber.

The incinerator according to the U.S. Patent specification is mainly intended for burning garbage, leaves, green grass, papers, etc. and provides to some extent a possibility to reduce the pollution from the gases exhausted from the combustion chamber through the stack by controlling the supply of oxygen to the incinerator chamber and by burning of the leaving gases in the combustion chamber. However, the control of the oxygen supply to the incinerator chamber disclosed in the U.S. Patent does not provide for a close control of the destruction process in the incinerator chamber, because the oxygen supply to the incinerator chamber is dependent upon the presence of oxygen at the rear portion of the combusion chamber, and the presence of oxygen there is dependent upon both the oxygen supply to the combustion chamber from the environment and also the consumption of oxygen in the combustion chamber. The consumption of oxygen in the combustion chamber is to a great extent dependent upon the chemical composition of the gases introduced into the combustion chamber from the incinerator chamber. Evidently, this composition can change heavily during the burning of mixed refuse. Furthermore, the incinerator chamber and the refuse contain, from the beginning, large quantities of oxygenous air and, therefore, during the first part of the destruction process the burning of the refuse can not at all or only to a slight extent be controlled by the oxygen supply from the combustion chamber. A combustion process controlled by the oxygen supply to the incinerator chamber will also be very time-consuming.

The main object of the present invention is to provide a method for separation of substances during a destruction process that enables a close control of the destruction process during the whole process. A further object is to enable a rapid destruction of waste and refuse in an economical way. Still a further object is to provide an efficient oven for carrying out the method.

The above objects are obtained according to the invention by a method and an oven having the features set forth in the claims.

The present invention distinguishes over what is previously known through the mentioned U.S. Patent by the fact that it is based upon the idea that the heating of the material or the waste and the maintaining of the temperature in the oven chamber shall be provided by passing heated gases through the oven chamber. The circulated quantity as well as the temperature of the gases can then be closely controlled by well known conventional means. Normally, in order to heat the waste rapidly to the desired temperature large gas quanitites are required, and these large quanitites have to be heated before the introduction into the oven chamber and to be cleaned after the exhaustion from the oven chamber. This leads to high operating costs and high installation costs for filtering and cleaning constructions for the exhausted gas quantities. These costs would render the method uneconomical.

According to the invention, this problem has been solved by using a combustion chamber know per se for burning the gases exhausted from the oven chamber together with support fuel from a gas or oil burner, so that the gases are cleaned and decomposed or oxidized to substances which are easy to separate or harmless to the environment. Through the use of a combustion chamber having a suitable temperature the following filtering or cleaning is made easier and cheaper.

The novelty of the invention resides in the fact that a large portion of the gas quantity passing through the combustion chamber is recirculated through the oven chamber for heating and holding warm the waste. Normally, the by far largest portion is recirculated and only a small portion of the gas quantity from the combustion chamber is diverted to the atmosphere, e.g. through filtering and cleaning equipment. Because the diverted gases have a small volume and possibly a high concentration of incombustible substances a reduction in the operation and installation costs is obtained so that the method becomes very economical.

The invention will now be explained more in detail below in connection with the description of one embodiment of a separation oven for carrying out the method and with reference to the accompanying drawings.

Figure 1:
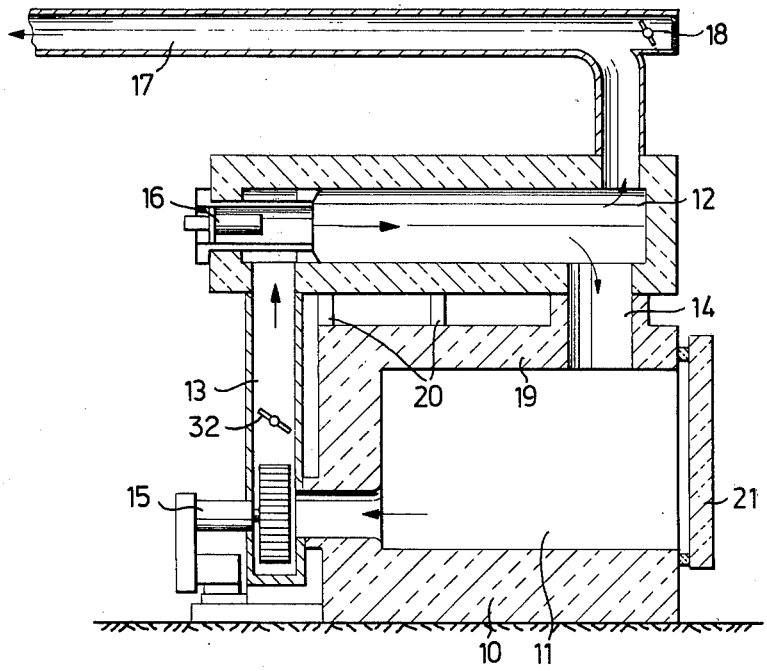
FIG. 1 is a schematic view of a separation oven according to the invention.

The separation oven 10 shown in FIG. 1 comprises an oven chamber 11 and an elongated combustion chamber 12. The oven chamber is connected to the combustion chamber through a conduit 13, and the combustion chamber is connected to the oven chamber through a conduit 14. The conduit 13 from the oven chamber leads to one end of the combustion chamber and the conduit 14 to the oven chamber is provided at the opposite end of the combustion chamber. A blowing fan 15 is connected in the conduit 13 from the oven chamber, and this fan can provide a gas circulation from the oven chamber to the combustion chamber and back to the oven chamber, as indicated by the arrows. An oil burner 16 is provided in the combustion chamber at the end where the gas from the oven chamber flows into the combustion chamber, for burning the passing gas or gas mixture. At the end of the combustion chamber opposite to the burner end an output conduit 17 is provided for diverting to the atmosphere a portion of the gas flowing through the combustion chamber. The diverted gas portion can pass through a special second combustion chamber and/or a cleaning filter, if necessary. The output conduit 17 is provided with an inlet 18 for cooling air in order to provide for a reduction of the temperature of the diverted gas.

In order to enable the circulation of large gas quantities through the oven chamber and the combustion chamber, the conduits 13 and 14 have large cross section areas and the blowing fan 15 has a high capacity. Further, the conduit 14 from the combustion chamber to the oven chamber has a substantially larger cross section area than the output conduit 17, so that the gas quantity recirculating through the oven chamber is substantially larger than the quantity diverted through the output conduit 17.

An overpressure is created in the combusion chamber and a depression is created in the oven chamber, because the blowing fan is positioned in the conduit 13. This depression eliminates the risk of gas flowing out from the oven chamber into the room where the oven is positioned.

The combustion chamber 12 is positioned on the roof 19 of the oven chamber 11 and is spaced therefrom by means of spacing elements 20. The oven chamber is provided with an openable door 21 for the introduction of waste, as shown at the right end of FIG. 1.

Figure 2:
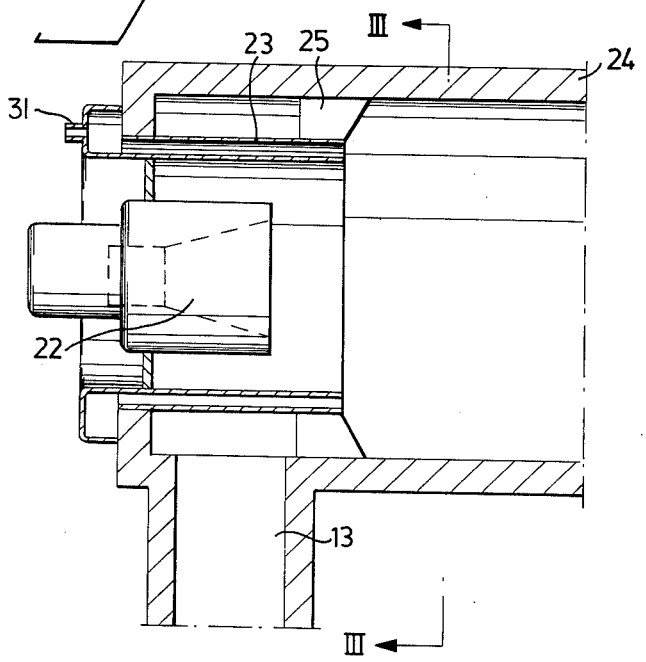
FIG. 2 is a section in larger scale through one end of the combustion chamber including the burner and the supply conduit for the gases.
Figure 3:
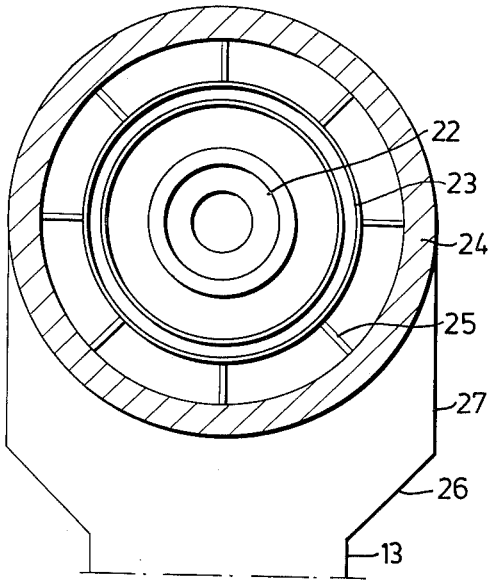
FIG. 3 is a section along the line III—III of FIG. 2.

FIGS. 2 and 3 show the combustion device more in detail. The burner comprises a tubular nozzle 22 positioned at the center of the combustion chamber gable, shown to the left in FIG. 2, and directed axially towards the interior of the combustion chamber. The nozzle is surrounded by a double-walled cylindrical screen tube 23, which is coaxially positioned with regard to the nozzle and in which the two walls are spaced radially. The inside diameter of the screen tube 23 is substantially longer than the outside diameter of the nozzle 22. The screen tube extends towards the interior of the combustion chamber past the whole mouth of the supply conduit for the gas from the oven chamber, as shown in FIG. 2.

The front end of the screen tube is connected to the walls of the combustion chamber by a number of plate-shaped elements 25 which are directed axially and which aim at guiding the gas stream substantially longitudinally through the combustion chamber, as will be explained more in detail below.

In operation, oil and primary air for the combustion of the oil are supplied through the nozzle 22. Secondary air is supplied from secondary air inlet 31 through the space between the two walls of the screen tube 23. The secondary air is necessary for the combustion of the gas coming from the oven chamber.

Due to the large quantities of gas to be circulated through the oven chamber and the combustion chamber, the gas will have a high speed in the conduit 13 after the blowing 15. The high speed can cause disturbances in the combustion chamber, because the flame is caused to flutter between the walls of the combustion chamber. This could lead to insufficient combustion of some portions of the flowing gas and to a risk of damages and heavy wear of the walls of the combustion chamber. In the oven according to the invention this problem has been solved by reducing the speed of the gas coming through the conduit 13 from the fan before the entrance of the gas into the combustion chamber. This has been provided by enlarging the conduit 13 and thus increasing the cross section area of the conduit before the point of connection to the combustion chamber. FIG. 3 shows a funnel-shaped portion 26 between the conduit 13 and a conduit 27 having larger cross section area than the conduit 13. It is convenient to position a conduit having a constant cross section area between the funnel-shaped portion and the combustion chamber, so that the gas can flow into the combustion chamber substantially at right angle to the longitudinal direction of the combustion chamber. This will prevent an oblique flow of gas into the combustion chamber which might force the burner flame towards one wall of the combustion chamber. Because the screen tube 23 extends past the whole inlet mouth, the gas flowing into the combustion chamber does not have any influence on the direction of the burner flame. Thus, the burner flame rests the whole time steadily in the center of the combustion chamber.

When the gas flows into the combustion chamber, a gas cushion of overpressure is formed at the end of the combustion chamber surrounding the screen tube 23. The gas flows from this cushion through the combustion chamber to the opposite end of the combustion chamber. Due to the guiding plates 25 at the front end of the screen tube, the flowing gas is directed substantially longitudinally and is uniformly distributed along the periphery. As mentioned above, this is a condition for a reliable operation of the burner. By supplying secondary air symmetrically through the screen tube and at a radial distance from the burner, a further improvement of the stabilization of the flame in the center of the combustion chamber is obtained.

The flame has its highest temperature in a layer at the outer portion of the flame. It is, therefore, desirable that the gases pass through this layer or close to it. For this reason, the distance between the outer portion of the flame and the walls of the combustion chamber must be kept small. This condition together with the desideratum that the flame should be long, so that the flowing gas passes in or close to the flame for a long distance, demands a high flame stability and flame centration along the longitudinal central axis of the combustion chamber. The purpose of the described devices adjacent the burner is to provide a combustion chamber fulfilling these demands.

In the leading paragraph has been mentioned that the method is particularly intended for destruction of paint or varnish layers on aluminum plates. Such paint or varnish layers normally contain large quantities of chlorine and fluorine which are poisonous and therefore harmful to the environment. If painted or varnished aluminum plates are melted without first removing the paint or varnish layers large quantities of poisonous gases are released in a very short time, and these quantities cannot be collected in a safe way. However, the problem can easily be solved by treating the painted or varnished aluminum plates before melting in a separation oven of the above described type.

Figure 4:
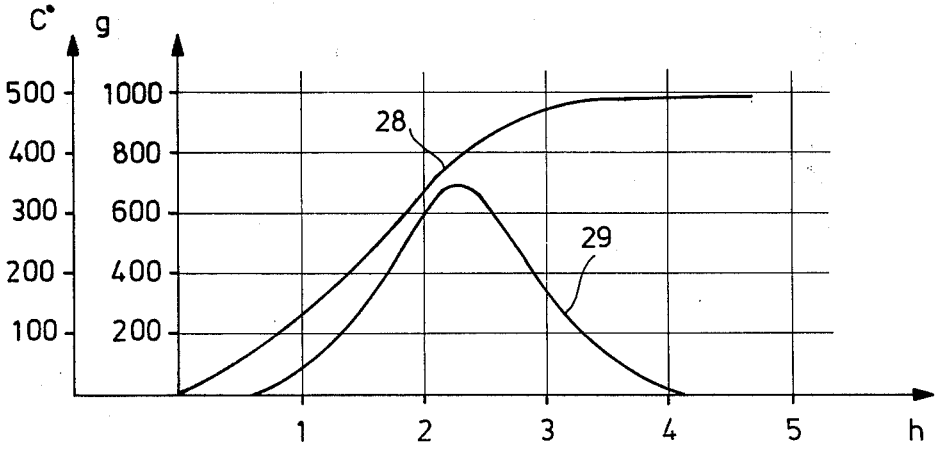
FIG. 4 illustrates a separation process according to the invention.

When using the invention for destruction of paint or varnish on aluminum plates, a charge of painted or varnished aluminum plates is introduced into the oven chamber and the the burner and the fan are started. Large quantities of gas having an easily controllable temperature are then caused to circulate through the oven chamber for heating the charge to the desired temperature, which is about 400° C for polyvinyl chloride varnish (PVC) and about 500° C for polyvinyl fluoride varnish ($PVF_2$). FIG. 4 shows a graph 28 of the temperature rise as a function of time and a corresponding graph 28 of the gasification or evaporation of the varnish or paint. The temperature can easily be controlled in the described method by controlling the temperature in the combustion chamber or the circulating gas quantity. By controlling the temperature in the oven chamber the evaporation can be controlled, so that a gas quantity larger than the quantity which can be collected by the installed equipment is not released. On the other hand, the evaporation rate can always be kept so high that the capacity of the installed equipment is fully used, in order to provide a rapid and economical destruction of the paint or varnish layers in a way which is safe from the environmental point of view.

In the described process of destruction of the paint or varnish layers the fan preferably has a capacity of 10,000 $m^3$ per hour. The combustion chamber has a temperature of about 700° C, and about 1100 $m^3$ gas per hour is diverted from the combustion chamber to a cleaning filter for exhausting into the atmosphere. The rest of the gas quantity passing through the combustion chamber is recirculated through the oven chamber. The diverted gas quantity corresponds to the contribution obtained by the primary and secondary air supplied to the combustion chamber. Thus, in the example described, about 10% of the gas volume in the combustion chamber is diverted to the atmosphere.

The ratio between the gas quantity diverted to the atmosphere and the gas quantity recirculated to the oven chamber can easily be controlled as desired, either by means of an adjustable damper 32 in the conduit 13 from the oven chamber where the temperature in the circulation path is the lowest, or by changing the rotation speed of the fan. A chaange of the ratio can be desirable to regulate or adjust the output quantity of contaminants or to control the temperature in the oven chamber. The diverted gas quantity corresponds to the supplied air.

While only one application of the method has been described, it is evident that the method due to the inherent control possibilities can be used for many different separation processes. Normally, gasification of the substances to be separated is provided, but separation can be accomplished principally by changing the state of aggregate of the substance, so that the substance is removed either in the form of a gas or in the form of a liquid. In the last mentioned case, a collecting device can be positioned under the oven chamber or on the floor of the oven chamber. Substances can also be removed as dust or otherwise carried away by the gas stream passing through the oven chamber. As mentioned,, the temperatures can easily be adjusted after the substances to be separated and burned in the combustion chamber. By the close control of the temperature in the oven chamber made possible by the invention, different substances can be released at different times which highly facilitates the recovery. The described separation oven can also be modified in many ways.

The combustion chamber may not necessarily be positioned on top of the oven chamber but may as well be positioned at one side. In the combustion chamber the gases separated in the oven chamber are dissolved or burned with the support fuel from the gas or oil burner and with a quantity of air, controlled in a known way, in the best way with regard to the combustion. In the combustion chamber air is added for obtaining a combustion close to stoichiometric or understoichiometric combustion. Furthermore, support fuel can be added, if needed, e.g. at the beginning or at the end of a charge, or when the portion of the combustible substance is too small. The temperature in the combustion chamber is controlled by the supply of support fuel and/or additional air. Due to the fact that the combustion chamber has been provided with suitable devices for supply of gases from the oven chamber, additional fuel and additional air, a possibility has been provided for controlling the complete process and, thus, the evaporation or emission process. If during a special process the actual temperature in the combustion chamber is too low, or the added air quantity is too small for obtaining a complete combustion of the gases, an after-burning chamber of known type can be used for a second burning of the gases from the combustion chamber. An advantage is that the second combustion chamber will have small dimensions with regard to the capacity of the plant.

The connections between the oven chamber and the combustion chamber can be arranged in another way and can consist of a single conduit or multiple conduits. The oven chamber as well as the combustion chamber can have another shape than shown on the drawings. The supply of gas from the oven chamber can also take place through the gable-end of the combustion chamber in the longitudinal direction of the combustion chamber.

To sum up, previously known ovens and processes with or without recirculation are based upon a more or less complete burning in the oven chamber and an after-burning of fumes in one or more combustion chambers. For the burning a minimum content, normally about 30–70%, of available air is necessary in the oven temperature. This minimum content is then available all over the oven chamber and the process will be difficult to control. The evaporation or emission according to the new process can take place completely without free oxygen in the oven atmosphere, and oxygen supply to the oven chamber should be avoided. A small supply of oxygen to the oven chamber is no bar for the method according to the invention, but the oxygen supply must be kept so small that no real burning can take place in the oven chamber. In the combustion chamber, oxygen necessary for the combustion is supplied and the process can be controlled by means of previously known equipment.

If the burning of the substances exhausted from the oven is not required, e.g. if the oven is used for drying or for removing harmless substances, the diversion of fumes can take place before the combustion chamber to save fuel.

We claim:

1. Method for controlled separation of substances by heating, including the steps of:

a. introducing a material from which one or more substances are to be separated into a closed oven chamber;

b. introducing into the oven chamber a gas which has been heated to a temperature sufficient to evaporate one or more of the substances to be separated, and containing insufficient oxygen to permit substantial burning in the oven chamber;

c. extracting the heated gas together with the evaporated substances from the oven chamber to create a depressed pressure in the oven chamber;

d. forcing the extracted gas to a combustion chamber;

a. burning the evaporated substance in the combustion chamber;

f. recirculating a portion of the gas passing through the combustion chamber to the oven chamber as the gas introduced in step (b) and back to the combustion chamber in accordance with step (d), for continuous heating; and g. diverting a portion of the gas from the combustion chamber to the atmosphere.

2. Method according to claim 1, in which the largest portion of the gas passing through the combustion chamber is recirculated through the oven chamber.

3. Method according to claim 2, in which about 90% of the gas quantity passing through the combustion chamber is recirculated through the oven chamber and the rest is diverted to the atmosphere from the combustion chamber.

4. Method according to claim 1 in which the gas quantity recirculated from the combustion chamber through the oven chamber is kept substantially free from oxygen.

5. Method according to claim 2 in which the material introduced in step (a) is aluminum waste having paint or varnish thereon, said gas introduced in step (b), has been heated to a temperature providing evaporation of one or more of the substances of the paint or varnish, and further including the step of maintaining a temperature in the combustion chamber of about 700° C and in the oven chamber of about 400°–500° C.

6. Oven for controlled separation of substances by heating, comprising;

a closed oven chamber for receiving material from which one or more substances are to be separated;

gas supply means for supplying to said oven chamber a gas heated to a temperature sufficient to evaporate one or more of the substances to be separated, and containing insufficient oxygen to permit substantial burning in the oven chamber;

a combustion chamber having heating means for heating said combustion chamber to a temperature sufficiently high for burning the evaporated substances;

extraction means for extracting the gas from said oven chamber and for creating a depressed pressure in said oven chamber;

conducting means for conducting the extracted gas quantities from said oven chamber to said combustion chamber:

recirculation means for recirculating a portion of the gas from said combustion chamber to said oven chamber, as the gas supplied by said gas supply means, the recirculation providing the heating of the material introduced into said oven chamber to the temperature required for evaporation of the substances to be separated; and diversion means for diverting a portion of the gas from said combustion chamber to the atmosphere.

7. Separation oven according to claim 6, in which said extraction means comprises a conduit between said oven chamber and said combustion chamber and a blowing fan connected in said conduit; said recirculating means comprises at least one conduit between said combustion chamber and said oven chamber; and said diversion means comprises an output conduit, the total cross section area of said conduit between said combustion chamber and said oven chamber being substantially larger than the cross section area of said output conduit.

8. Separation oven according to claim 7, further including speed reduction means provided in the conduit between said oven chamber and said combustion chamber for reducing the speed of the gas coming from said oven chamber before the introduction thereof into said combustion chamber.

9. Separation oven according to claim 7, wherein said combustion chamber comprises:

an elongated chamber.

an oil burner at one end of said chamber, the flame therefrom being directed in the longitudinal direction of said chamber, the gas from said oven chamber being supplied in the direction perpendicular to the longitudinal direction of said chamber at the end where the burner is positioned, and the gas from said combustion chamber being recirculated to said oven chamber, from the opposite end from the burner;

a nozzle in said oil burner; and a substantially cylindrical tube positioned at the center of the end wall of said chamber and around said nozzle, said tube extending axially towards the interior of said chamber past the whole inlet mouth of said conduit supplying gas from said oven chamber, so that the gas flowing into the combustion chamber does not have any influence on the direction of the burner flame.

10. Separation oven according to claim 9, in which said tube is provided with a number of radially extending guiding plates directed in the longitudinal direction of said chamber, said plates guiding the gas flowing into said chamber at its end in the longitudinal direction of said chamber.

11. Separation oven according to claim 9, in which said tube comprises a double-walled tube, the walls thereof being spaced apart, and further including secondary air supply means for supplying secondary air to said chamber.

12. Separation oven according to claim 11, in which said tube has an inner diameter substantially larger than the outer diameter of the nozzle, so that the secondary air flowing from the tube limits and stabilizes the burner flame substantially along the longitudinal axis of said chamber.

13. Separation oven according to claim 7, further including an adjustable damper means provided in said conduit between said oven chamber and said combustion chamber for controlling the ratio between the gas quantity diverted to the atmosphere and the gas quantity recirculated to said oven chamber.

14. Separation oven according to claim 6, further including control means for controlling and maintaining the temperature in said oven chamber and in said combustion chamber to predetermined parameters.

* * * * *